United States Patent [19]

Buckley

[11] Patent Number: 4,805,327

[45] Date of Patent: Feb. 21, 1989

[54] TV COMMERCIAL STORY BOARD

[76] Inventor: John Buckley, 433 California St., San Francisco, Calif. 94104

[21] Appl. No.: 90,016

[22] Filed: Aug. 27, 1987

[51] Int. Cl.[4] ..... A47G 1/06

[52] U.S. Cl. ..... 40/159

[58] Field of Search ..... 40/159, 158 R, 124.2, 40/405, 537

[56] References Cited

U.S. PATENT DOCUMENTS

| | | | |
|---|---|---|---|
| 1,232,898 | 7/1917 | Dawson | 40/159 |
| 2,154,510 | 4/1939 | King et al. | 40/159 |
| 2,538,894 | 1/1951 | Bender | 40/158 |
| 2,828,567 | 4/1958 | Shoan | 40/158 |
| 3,869,820 | 3/1975 | Holson | 40/159 |
| 4,016,664 | 4/1977 | Kaufmann | 40/159 |

*Primary Examiner*—Gene Mancene
*Assistant Examiner*—Cary E. Stone
*Attorney, Agent, or Firm*—Julian Caplan

[57] ABSTRACT

A foldable board is useful for developing, presenting to clients and storing key video and audio portions of proposed TV commercials. The board preferably has three panels joined together by a decorative backing or cover and foldable along vertical lines. Each panel has a front facing having two or more vertically spaced windows cut out in the shape of a TV screen and adjacent the window is a slot through which a sketch of a TV scene may be inserted. Below each window is space to attach a label bearing an audio statement corresponding to the video scene in the window. Behind the facing is a sheet of vinyl or other material and behind the vinyl is a stiffener of cardboard or the like. Each sketch is inserted through the appropriate slit and adheres to the vinyl by friction and tight fit. Scenes and labels may be changed as production of the commercial develops.

5 Claims, 1 Drawing Sheet

TV COMMERCIAL STORY BOARD

CROSS-REFERENCE

Applicant refers to Disclosure Document 156772 filed Oct. 2, 1986.

BACKGROUND OF THE INVENTION

1. Field of the Invention

This invention relates to a new and improved story board for use in designing, presenting to clients and storing video and audio portions of TV commercials, movies, video tapes and the like.

2. Description of Related Art

Heretofore, a common means for designing TV commercials is the use of a rigid backing board which has been marked on its surface with the outline of the shape of a TV screen, or overlayed with a TV window frame. Pictures depicting key scenes of the proposed commercial are taped or pasted within or under the outlines or windows and captions of the audio portion of the commercial describing the scene are pasted below the screen.

Various means for mounting films beneath holders which are cut out to expose an underlying film such as an X-ray film are shown in such patents as 4,110,924, 4,110,923, 3,070,915, and 3,894,684.

Photographic albums and files for holding transparencies are shown in such patents as 3,797,152 and 2,828,567.

The concept of flexible displays for advertising and other purposes are shown in such patents as 2,631,046 and 3,725,651.

None of the foregoing related art describes and illustrates the specifics of the story board which is illustrated herein and hereinafter described.

SUMMARY OF THE INVENTION

Advertising agencies design television commercials by use of a "story board" which graphically displays key scenes in the proposed commercial. Thus, for a one-minute TV commercial, six or nine key scenes in the sequence of the commercial may be sketched by a commercial artist and mounted on a story board of the type heretofore described. Beneath the sketches are typed portions of the audio script which accompanies each individual scene. Such a story board, after it has been approved by the advertising agency, is shown to the representative of the prospective client. In this process there are frequent revisions of both the video and audio portions of the commercial.

The present invention provides a relatively inexpensive and extremely convenient means for accommodating frequent changes in both the visual and spoken portions of the commercial without the cost of actually filming or taping the commercial.

Prior art story boards have been cumbersome. The present invention provides for a foldable board which is convenient for transportation and/or storage. Further, because there are preferably three panels which can be opened so that they are almost parallel, the device will stand on edge for convenience in examining the graphics displayed therein.

The board is attractive in appearance. The backing or cover of the board is of a material such as colored vinyl and the colors of the vinyl may be coded for ready reference. The backing can also be made of other materials such as synthetic boards, etc.

Essentially the present invention eliminates the necessity of pasting sketches on a board and the inconvenience of removing the sketches and captions when changes are necessary. Further, the board is much easier to handle and carry.

Other objects of the present invention will become apparent upon reading the following specification and referring to the accompanying drawings in which similar characters of reference represent corresponding parts in each of the several views.

IN THE DRAWINGS

DESCRIPTION OF PREFERRED EMBODIMENT

The story board of the present invention consists of three rectangular panels 11*a*, 11*b* and 11*c*. Joining the panels together is a back cover 12, preferably of an attractive vinyl material which may be color coded for particular clients or for other purposes. The backing 12 also partly serves as a hinge material for the individual panels 11*a*, 11*b* and 11*c* as they are folded in folds 13. It will be understood that three vertically elongated panels are illustrated herein but that the number of such panels and their dimensions may be varied.

Figure 2:
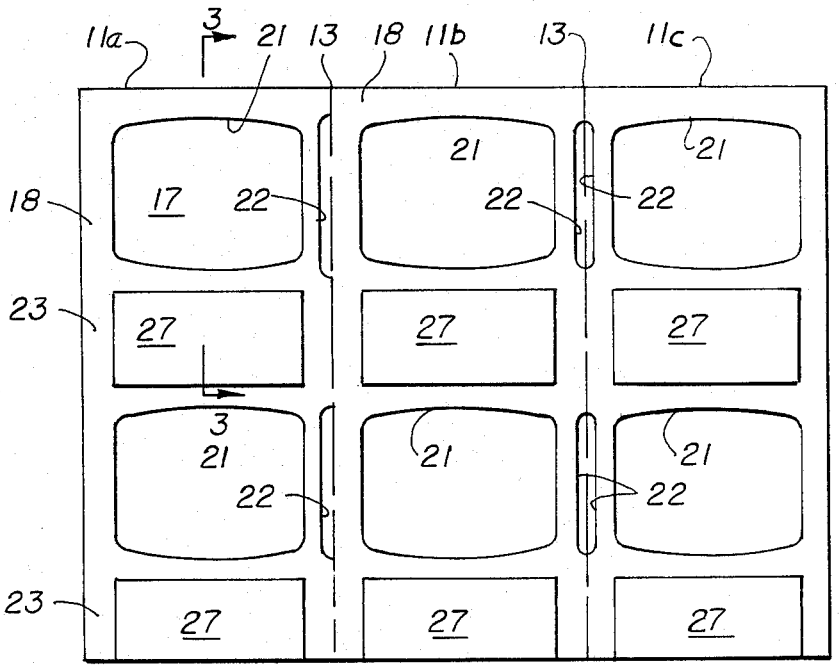
FIG. 2 is a plan view of the complete story board spread out flat.

Sealed within each panel is a rectangular piece of cardboard 16 which serves as a stiffener, it being understood that the margin of the cardboard 16 terminates adjacent but spaced from folds 13. Sealed over the ace of cardboard 16 is a panel 17 of white vinyl or other suitable material. Above the vinyl 17 is a facing or mask 18 which may be sealed thereto. The facing 18 is cut out in windows 21 which resemble the shape of a TV screen. As shown in FIG. 2, there are two windows 21 vertically spaced apart in each panel. It will be understood that the number, shape and spacing of such windows 21 is subject to variation.

To one side of each window 21 and adjacent fold 13 is a slit 22 which has a length slightly larger than the length of the window 21 and a width sufficient for the user to insert between the facing 18 and the vinyl 17 a sketch 24 as hereinafter described. Below each window 21 is a space 23 for a label 27 on which is typed or otherwise lettered a caption representing the audio portion of the commercial which accompanies the particular sketch 24 inserted in the window 21 thereabove. Labels 27 are preferably attached in the spaces 23 by pressure sensitive adhesive 28, spray glue or other means.

In the use of the device, a commercial artist prepares a series of sketches 24 representing key scenes or episodes in the proposed commercial. Simultaneously with the preparation of the sketches 24, the captions which accompany the sketches are applied to corresponding labels 27. The user then inserts sketches 24 through the slits 22 so that the sketch is centered relative to a window 21. The sketch 24 is not glued to the vinyl 17 but adheres thereto either by friction or by the tightness of the fit of the front facing 18 relative to the vinyl 17. If it is necessary in the development of the commercial to remove a sketch 24, this is easily accomplished by withdrawing it through the slit 22. Audio portions of the commercial are displayed on labels 27 which are attached below each window 21 in a corresponding space 23. By reason of the means of attachment of the labels 27, they may be readily removed. Insertion, withdrawal and rearrangement of sketches is easily accomplished.

Figure 4:
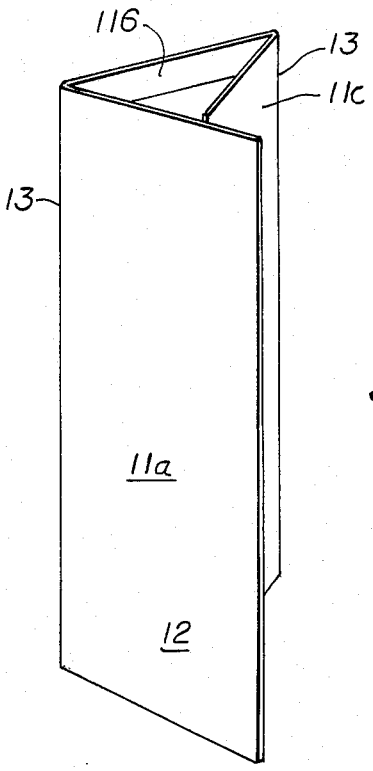
FIG. 4 is a perspective view showing the device in the act of being folded for transportation or storage.
Figure 1:
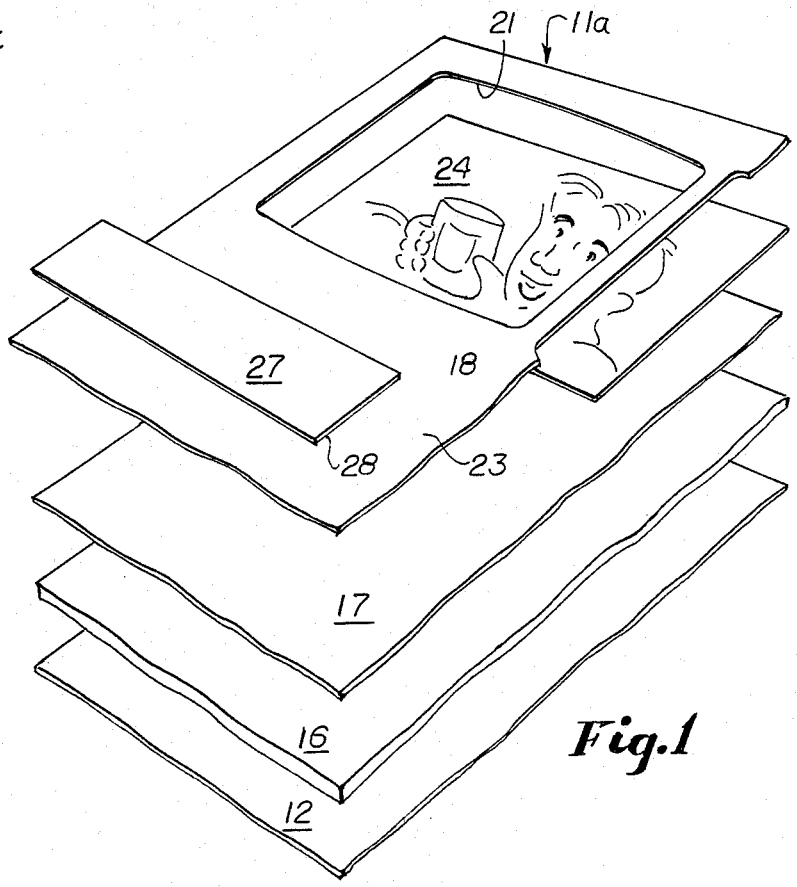
FIG. 1 is an exploded perspective view of one corner of one panel of a story board in accordance with the present invention.
Figure 3:
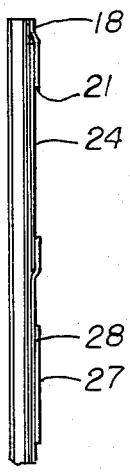
FIG. 3 is an enlarged sectional view taken substantially along the lines 3—3 of FIG. 2.

Frequently it is necessary to transport the story board to the location of the prospective client. This is readily accomplished by folding the panels together as shown in FIG. 4. In order to view the commercial as a whole, the story board may be folded flat on a table as shown in FIG. 2 or by slightly turning panels 11*a* and 11*c* inward relative to panel 11*b*, the board will stand on edge without support.

What is claimed is:

1. A display board comprising a composite panel having a stiffener, a sheet of vinyl-like material affixed to said stiffener, a front-facing over said vinyl-like material, said facing being cut away in a plurality of windows, said front facing being loose relative to said vinyl-like material in the areas around each said window, a sketch sheet for each said window having a drawing thereon inserted between said vinyl-like material and said facing and visible through one said window, said front facing being formed with a slit adjacent each said window through which said sketch-sheet may be inserted under said front-facing, said vinyl-like material being of a type which restrains by friction unintentional movement of said sketch from a position under said window.

2. A board according to claim 1 in which windows are spaced relative to the margins of said board to provide spaces for labels, and a label bearing a caption adhered to each said space.

3. A board according to claim 1 further comprising a second panel substantially identical to said first-named panel, said first-named and second panels being hinged along common longitudinal edges.

4. A board according to claim 3 further comprising a cover in back of both said stiffeners and adhered to said stiffeners, said cover in the area between said stiffeners comprising a hinge for said first-named panel.

5. A board according to claim 4 further comprising a third panel hinged to said second panel along a longitudinal edge of said second panel opposite said first-named panel.

* * * * *